US012392200B2

(12) United States Patent
Villa de Santana et al.

(10) Patent No.: US 12,392,200 B2
(45) Date of Patent: Aug. 19, 2025

(54) FLUID OPERATED MOTOR FOR RUNNING CASING WITH BYPASS FOR PUMPING LOST CIRCULATION MATERIAL

(71) Applicant: Deep Casing Tools Limited, Aberdeenshire (GB)

(72) Inventors: Rafael Villa de Santana, Aberdeen (GB); David Stephenson, Aberdeen (GB)

(73) Assignee: Deep Casing Tools Limited, Aberdeenshire (GB)

( * ) Notice: Subject to any disclaimer, the term of this patent is extended or adjusted under 35 U.S.C. 154(b) by 0 days.

(21) Appl. No.: 18/620,504

(22) Filed: Mar. 28, 2024

(65) Prior Publication Data

US 2024/0328260 A1 Oct. 3, 2024

(30) Foreign Application Priority Data

Mar. 28, 2023 (GB) ..... 2304509.9

(51) Int. Cl.
*E21B 10/26* (2006.01)
*E21B 7/20* (2006.01)
*E21B 21/10* (2006.01)

(52) U.S. Cl.
CPC ..... *E21B 10/26* (2013.01); *E21B 7/208* (2013.01); *E21B 21/103* (2013.01)

(58) Field of Classification Search
CPC ..... E21B 10/26; E21B 21/103; E21B 21/10; E21B 4/02; E21B 7/208
See application file for complete search history.

(56) References Cited

U.S. PATENT DOCUMENTS

2009/0095528 A1* 4/2009 Hay ..... F04C 14/06 175/26
2013/0306376 A1* 11/2013 Walerianczyk ..... E21B 4/02 175/57
2021/0189863 A1* 6/2021 Gooneratne ..... E21B 47/09

FOREIGN PATENT DOCUMENTS

CN 108625786 A 10/2018

OTHER PUBLICATIONS

Search Report, British Patent Application No. 2304509.0 issued Sep. 11, 2023.

* cited by examiner

*Primary Examiner* — Caroline N Butcher
(74) *Attorney, Agent, or Firm* — Richard A. Fagin

(57) ABSTRACT

A reaming tool includes a housing having a connection at one end for coupling to a pipe string. The housing defines at least one of a rotor and a stator of a turbine. A rotor shaft is rotatably supported on the housing. The rotor shaft has an interior passage and defines the other of a stator and a rotor of the turbine. The rotor shaft has a coupling at one end to attach a well intervention tool. A flow diverter is disposed within the housing. The flow diverter comprises ports to selectively direct flow of fluid from an interior of the housing to either (i) an annular space between the housing and the rotor shaft, or (ii) the interior passage of the rotor shaft. The flow diverter is operable to change direction of the flow of fluid by changing a flow rate of the flow of fluid.

16 Claims, 5 Drawing Sheets

FLUID OPERATED MOTOR FOR RUNNING CASING WITH BYPASS FOR PUMPING LOST CIRCULATION MATERIAL

CROSS REFERENCE TO RELATED APPLICATIONS

Priority is claimed from British Patent Application No. 2304509.9 filed on Mar. 28, 2023.

STATEMENT REGARDING FEDERALLY SPONSORED RESEARCH OR DEVELOPMENT

Not Applicable.

NAMES TO THE PARTIES TO A JOINT RESEARCH AGREEMENT

Not Applicable.

BACKGROUND

This disclosure relates to the field of fluid operated drilling motors. More particularly, the disclosure relates to fluid operated motors used to ream wellbores during insertion of wellbore protecting pipe ("casing" or "liner").

U.S. Pat. No. 7,849,927 issued to Herrera and U.S. Pat. No. 8,807,245 issued to Scott et al. describe various forms of fluid operated motors used in connection with the task of inserting a protective pipe such as a casing or liner into an open (unprotected) well after drilling thereof. In an example use of such fluid operated motors, a well having been drilled at a high inclination or even horizontally for an extended distance may have improved chance of the casing or liner reaching the bottom of the well by rotating a reaming shoe or similar device at the bottom end of the pipe "string" used to insert the casing or liner into the well. Fluid, e.g., drilling mud pumped through the pipe string causes the fluid operated motor to rotate the reaming shoe.

The fluid operated motor described in the Scott et al. '245 patent is a so-called "annular" turbine motor, wherein the rotating part (rotor) of the motor is rotatably supported within a housing, which comprises the fixed part (stator) of the motor. The housing is attached to the pipe string. The rotor may be substantially hollow, such that the motor may be left at the bottom of the well after the casing or liner is fully inserted, thus minimizing the amount of material that must be removed, e.g., by drilling or milling, in order to complete installation of the casing or liner. An illustrative example of an annular motor such as described in the Scott et al. '245 patent is shown in cross-sectional view in FIG. 1 and in enlarged view in FIG. 1A. The motor 100 may comprise a generally tubular shaped housing 102, having at one longitudinal end a threaded coupling 102A to connect the motor 100 to the bottom end of a string of pipe, e.g., a well lining tubular such as liner or casing. A power section 104 may comprise a plurality of stacked turbine stator elements and interleaved rotor elements. The stator elements may be fixed to the interior of a housing extension 102B, which part of the housing may extend to the axial location of a bearing section 106. Rotor elements of the power section may be coupled to the exterior of a rotor shaft 108, which shaft is rotatably supported and axially supported in the housing extension 102B by bearing elements in the bearing section 106. A reaming shoe 48 is coupled to the end of the rotor shaft 108 and is rotated by the power section when fluid passes through the turbine elements in the power section 104. Specifically referring to FIG. 1A, a flow diverter 110 may be disposed inside the housing 102 above the power section 104 and may close an interior passage 111 in the interior of the housing 102 to fluid flow. The flow diverter 110 may have internal passages to direct fluid flow into the annular space 112 between the housing 102 and the rotor shaft 108. During casing or liner running operations, the fluid flow may be used to operate the motor 100 to rotate the reaming shoe 48 as explained above. After the well lining tubular is run to the bottom of a well, the flow diverter 110 and the reaming shoe 48 may be removed such as by drilling, milling or solution (e.g., by acid or caustic chemical).

Fluid operated motors such as described in the Scott et al. '245 and patent and explained with reference to FIGS. 1 and 1A may be particularly susceptible to clogging or jamming if the well operator is required to circulate mud additives such as lost circulation materials—abbreviated LCM through the annular motor to reduce loss of drilling mud if the well penetrates subsurface formations susceptible to loss of drilling fluid, e.g., underpressured formations or highly fractured formations. LCM includes materials that facilitate forming an impermeable fluid barrier at the face of such formations, and by their very nature may facilitate clogging such motors, which have a small cross-sectional area.

There is a need for improved annular fluid operated motors that are less susceptible to clogging when LCM are used.

SUMMARY

According to one aspect, the disclosure provides a reaming tool as hereinafter set forth in claim 1 of the appended claims.

According to a second aspect, the disclosure provides a method for moving a tubular string along a well as hereinafter set forth in claim 5 of the appended claims.

A reaming tool according to the present disclosure includes a housing having a connection at one end for coupling to a pipe string. The housing defines at least one of a rotor and a stator of a turbine. A rotor shaft is rotatably supported on the housing. The rotor shaft defines the other of a stator and a rotor of the turbine. The rotor shaft defines an interior passage. The rotor shaft has a coupling at one end to attach a well intervention tool. A flow diverter is disposed within the housing. The flow diverter comprising ports to selectively direct flow of fluid from an interior of the housing to either (i) an annular space between the housing and the rotor shaft, and (ii) the interior passage of the rotor shaft. The flow diverter is operable to change direction of the flow of fluid by changing a flow rate of the flow of fluid.

In some embodiments, the flow diverter comprises a valve disposed in a valve body sealingly engaged with an interior of the housing. The valve body comprises a valve seat. The valve comprises a valve shuttle movably disposed within the valve body. The valve comprises a biasing device to urge the valve shuttle away from the valve seat to open the valve to flow to the interior passage against the flow of fluid, wherein fluid flow above a selected threshold moves the valve shuttle into contact with the valve seat to close fluid flow to the interior passage and open flow to the annular space.

In some embodiments, the biasing device comprises a coil spring.

Some embodiments further comprise a duck valve disposed in an hydraulic passage defined by the annular space. The duck valve is arranged to block flow from the annular space to the interior of the housing, and is arranged to open flow from the interior of the housing into the annular space.

A method for moving a tubular string along a well includes pumping fluid through a pipe string having a reaming tool attached to one end of the pipe string. The reaming tool comprises a housing having a connection at one end for coupling to a pipe string. The housing defines at least one of a rotor and a stator of a turbine. A rotor shaft is rotatably supported on the housing. The rotor shaft defines the other of a stator and a rotor of the turbine. The rotor shaft defines an interior passage. The rotor shaft has a coupling at one end to attach a well intervention tool. A flow diverter is disposed within the housing. The flow diverter comprises ports to selectively direct flow of fluid from an interior of the housing to either (i) an annular space between the housing and the rotor shaft, and (ii) the interior passage of the rotor shaft. The flow diverter is operable to change direction of the flow of fluid by changing a flow rate of the flow of fluid. The pumping fluid is performed at a first rate to cause the fluid flow to be directed to the annular space such that the rotor shaft turns, and a reaming shoe attached to the coupling rotates. The pipe string is moved along the well while the pumping is performed at the first rate. The rate of pumping fluid is changed to a second rate so that the flow is directed to the interior passage of the rotor shaft.

Some embodiments of a method further comprise adding lost circulation material to the fluid while performing the pumping at the second rate.

In some embodiments, the second rate is lower than the first rate.

In some embodiments, the flow being directed to the interior passage of the rotor shaft comprises urging a valve shuttle in a valve body away from a valve seat in the valve body, the urging performed by a biasing device arranged to opposed force on the valve shuttle effected by the flow of fluid.

Some embodiments further comprise causing the flow directed to the annular space to urge a duck valve to open flow in the annular space, the duck valve arranged to close flow from the annular space into the housing.

Other aspects and possible advantages will be apparent from the description and claims that follow.

BRIEF DESCRIPTION OF THE DRAWINGS

The invention will now be described further, by way of example, with reference to the accompanying drawings, in which.

DETAILED DESCRIPTION

Figure 1:
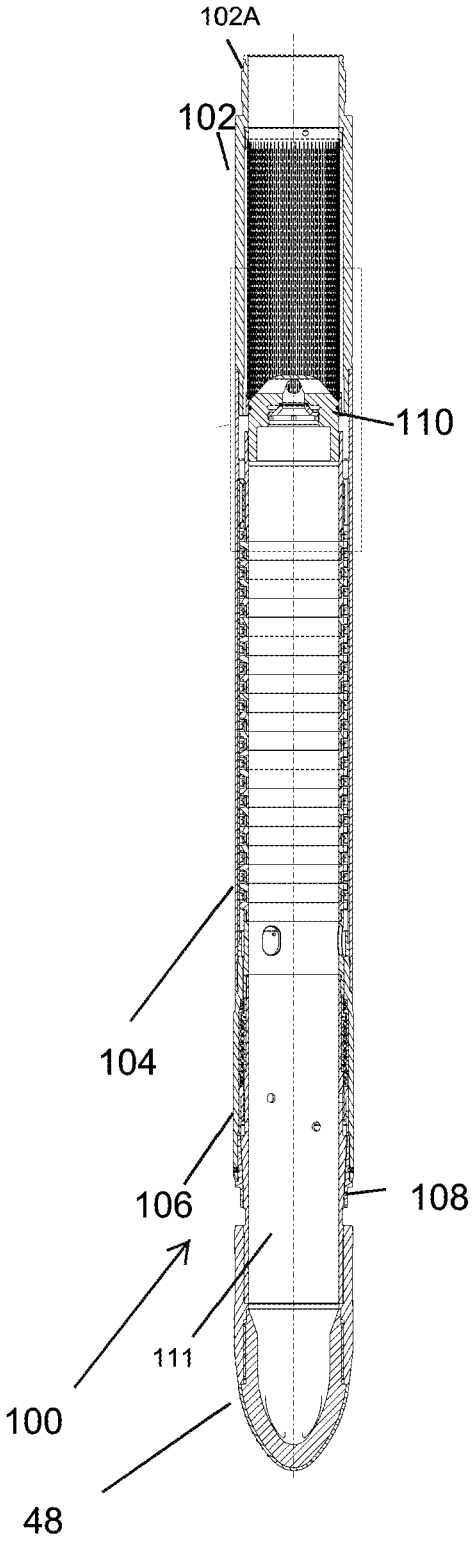
FIG. 1 (PRIOR ART)
FIG. 1 shows a cross-sectional view of an annular mud motor known in the art prior to the present disclosure.
Figure 1A:
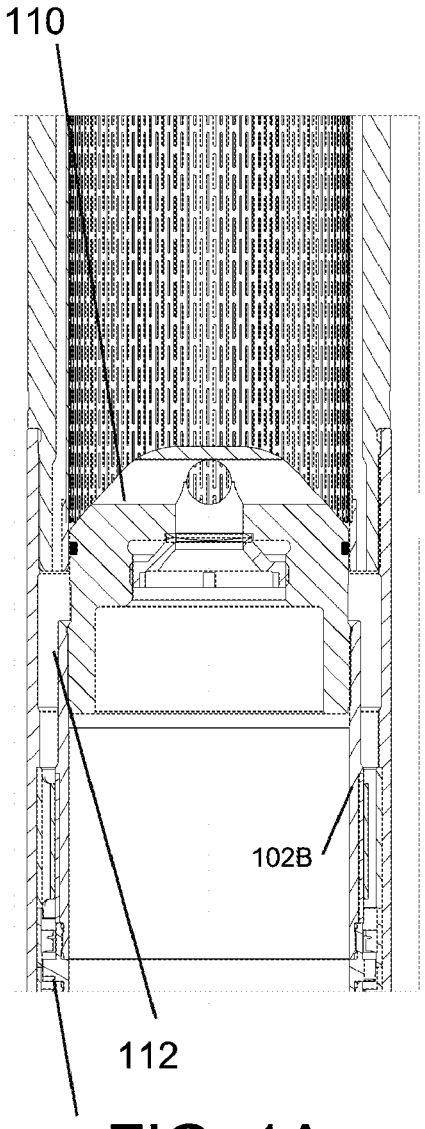
FIG. 1A (PRIOR ART)
FIG. 1A shows an enlarged section of the motor shown in FIG. 1.
Figure 2A:
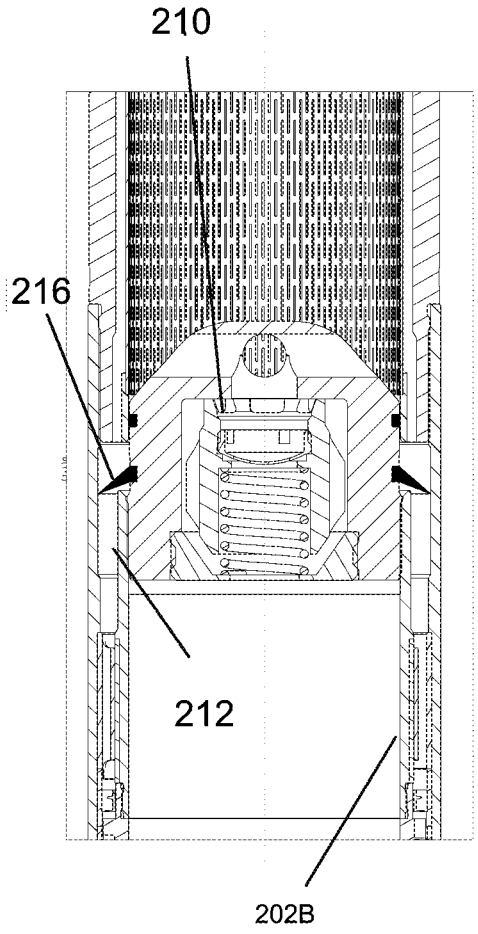
FIG. 2A shows an enlarged section of the motor shown in FIG. 2.
Figure 2:
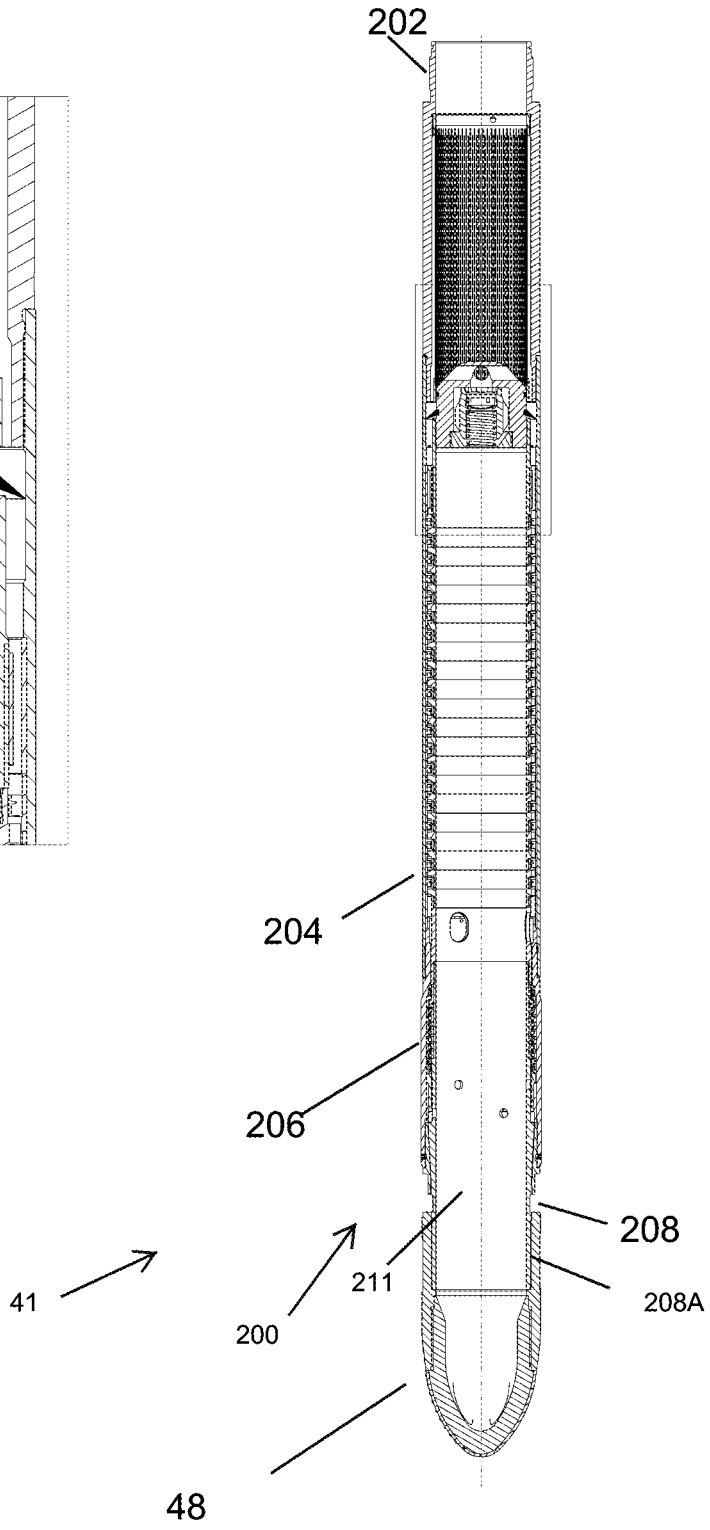
FIG. 2 shows a cross-sectional view of a mud motor according to the present disclosure.

FIG. 2 shows a cross-sectional view of a mud motor 200 according to the present disclosure; FIG. 2A shows an enlarged partial view of the mud motor 200 to illustrate components according to the present disclosure that provide particular functionality to the mud motor 200. The mud motor 200 may be structurally similar to a motor described in U.S. Pat. No. 8,807,245 issued to Scott et al. as set forth in the Background section herein with differences to be explained below. The mud motor 200 may comprise a generally tubular shaped housing 202, having at one longitudinal end a coupling such as a threaded coupling 202A to connect the mud motor 200 to the bottom end of a tubular string such as a string of well lining tubular such as liner or casing. A power section 204 may comprise a plurality of stacked turbine stator elements and interleaved rotor elements. The stator elements may be fixed to the interior of a housing extension 202B that may extend to the axial location of a bearing section 206. Rotor elements of the power section may be coupled to the exterior of a rotor shaft 208, which shaft is rotatably supported and axially supported on the housing extension 202B by bearing elements in the bearing section 206. The rotor shaft 208 may comprise a coupling, e.g., a threaded coupling, to which may be attached any form of well intervention tool, which in the present example may be a reaming shoe 48. The reaming shoe 48 may be rotated by the power section when fluid passes through the turbine elements in the power section 204.

Specifically referring to FIG. 2A, a flow diverter such as a valve, e.g., a dump valve 210 may be disposed inside the housing 202 above the power section 204 and may close an interior passage 211 in the interior of the housing 202 to fluid flow. In some embodiments, the flow diverter/dump valve 210 may have internal passages to direct fluid flow into the annular space 212 between the housing 202 and the rotor shaft 208 when the flow of fluid through the mud motor 200 exceeds a predetermined threshold. Expressed differently, the fluid flow through the mud motor 200 in such embodiments may be directed into the annular space 212 when the pressure drop across the motor 200 exceeds a predetermined threshold. When the fluid is moved into the annular space 212, flow of fluid operates the turbine elements in the power section 204 to rotate the rotor shaft (208 in FIG. 2) and the attached reaming shoe (48 in FIG. 2).

After the well lining tubular (see FIG. 3) is run to the bottom of a well, the flow diverter 210 and the reaming shoe 48 may be removed such as by drilling, milling or solution (e.g., by acid or caustic chemical). An upper entrance to the annular space 212 may be selectively closed by a one way (check) valve such as a duckbill (duck) valve 216, which may prevent backflow through the power section 204 when mud is directed to flow through the interior passage 211. The duck valve 216 may be made from elastomer such as nitrile rubber or polyurethane and may be disposed within a hydraulic passage defined by the annular space 212 such that fluid can flow in only one direction through the annular space 212. In the present example embodiment, the duck valve 212 may be disposed at an entry to the annular space 212.

In such embodiments, the flow diverter/dump valve 210 may, upon reducing the flow of drilling mud through the mud motor 200, or causing a corresponding reduction in pressure drop across the mud motor 200 below the selected threshold may open flow to the interior passage 211 and close flow to the annular space 212. In this way, should it become necessary to put material such as LCM into the drilling mud, the risk of clogging the mud motor 200 may be reduced by excluding flow of the LCM-containing mud into the turbine elements in the power section 204.

While the present example embodiment is described as having the rotor shaft rotatably supported inside the housing, it will be appreciated by those skilled in the art that a motor having an annular turbine may be configured to have the rotor shaft rotatably supported on the exterior of the housing. In such embodiments, the exterior surface of the housing may comprise stator elements of the turbine and the interior surface of the rotor shaft may comprise the rotor elements of the turbine.

In some embodiments, the operation of the flow diverter/dump valve 210 may be reversed from the above described embodiments, wherein flow of fluid into the mud motor 200 below a selected threshold may cause the flow diverter/dump valve 210 to close fluid flow to the interior passage 211 and open fluid flow to the annular space 212. Correspondingly, fluid flow into the mud motor 200 above the selected threshold may cause the flow diverter/dump valve 210 to open flow to the interior passage 211 and close flow to the annular space 212.

Figure 2B:
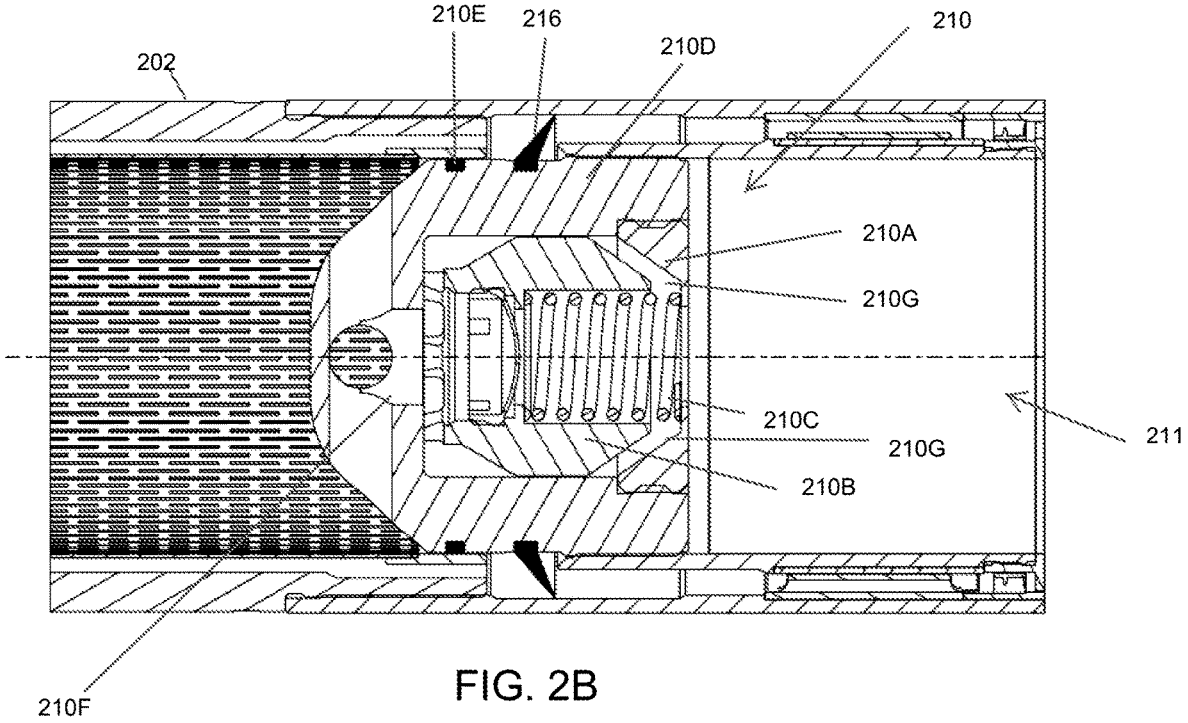
FIG. 2B shows an enlarged view of a dump valve and duck valve used in some embodiments.
Figure 2C:
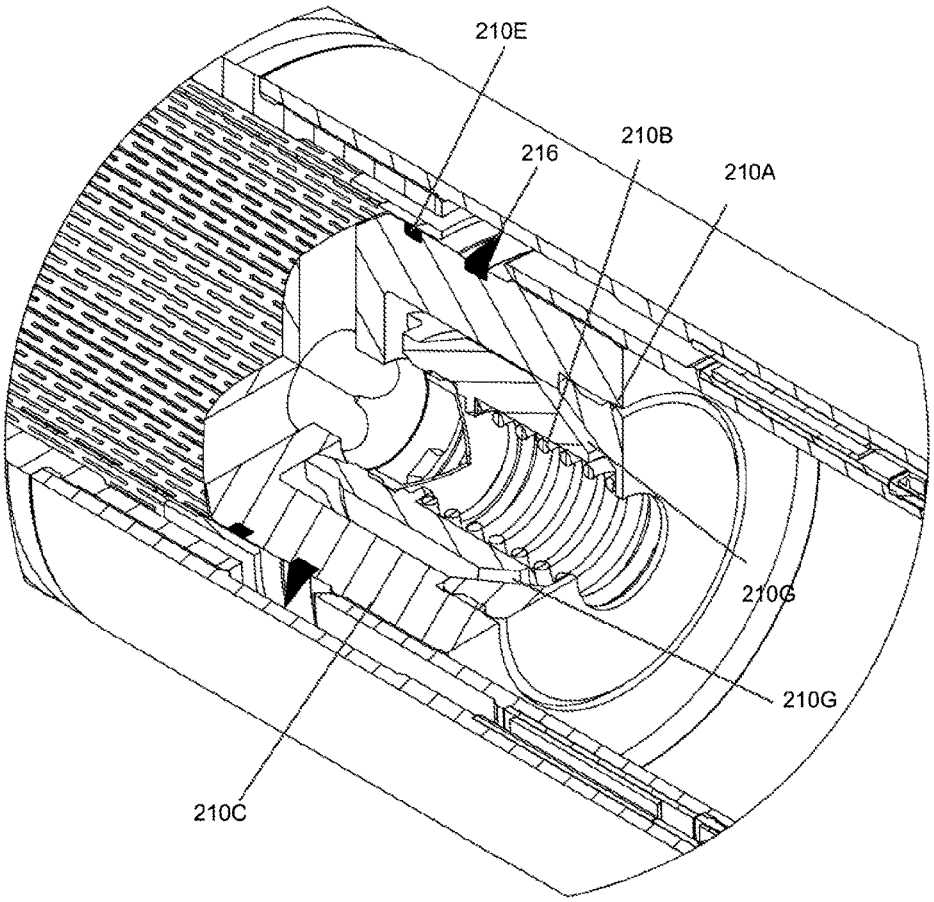
FIG. 2C shows an oblique view of the valves shown in FIG. 2B.
Figure 2D:
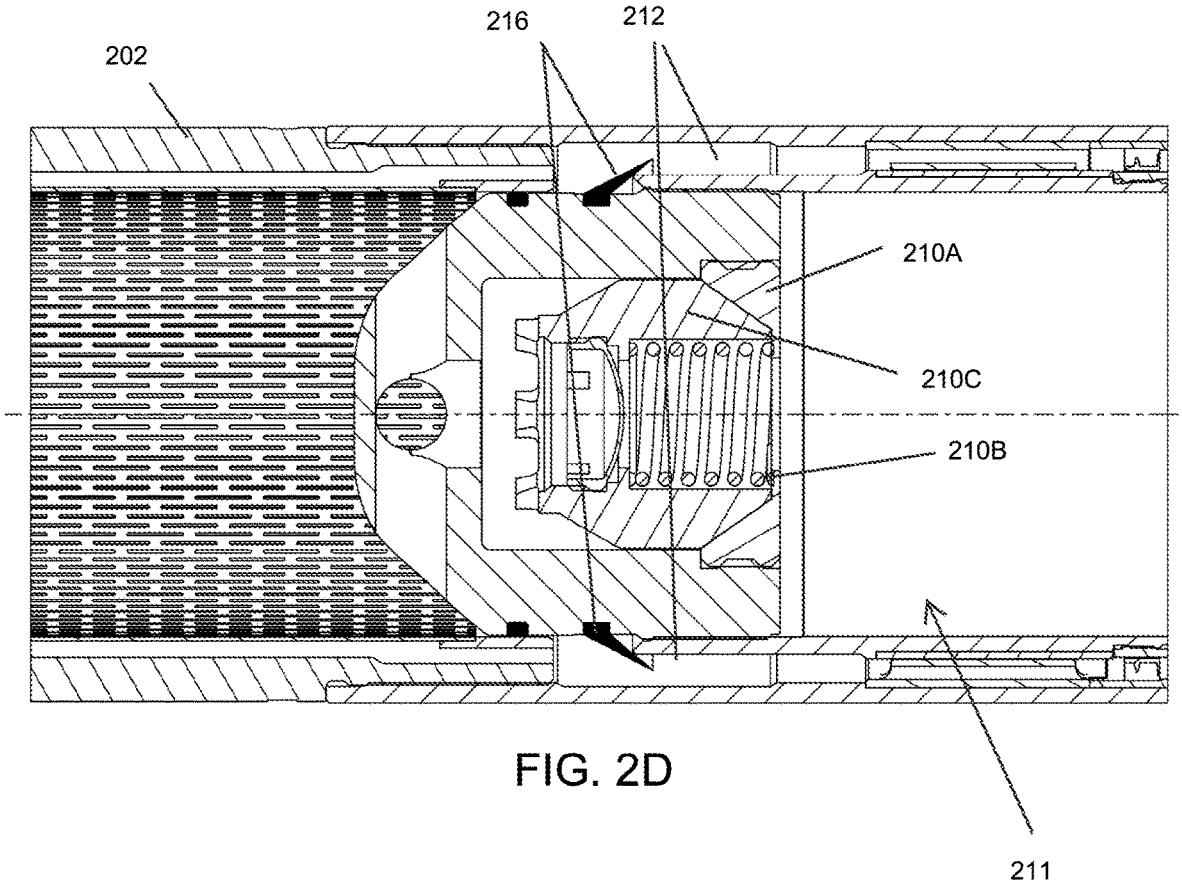
FIG. 2D shows the dump valve of FIG. 2B closed by flow and associated duck valve opened by flow to enable operating the motor of FIG. 2.

Operation of the diverter/dump valve 210 may be better understood with reference to FIGS. 2B, 2C and 2D, which show various views of the diverter/dump valve enlarged to make visible some of the active components.

FIG. 2B is a cross sectional view of the diverter/dump valve 210 in a position to allow fluid flow into the interior passage 211 and close flow to the annular space 212. In the present example embodiment, the diverter/dump valve 210 may comprise a valve body 210D that sealingly engages the interior surface of the housing 202, e.g., using a seal such as an o-ring 210E. A valve shuttle 210B may be movably disposed inside the valve body 210D. The bottom of the valve body 210D may comprise s valve seat 210A that provides sealing surfaces for the valve shuttle 210B when the valve shuttle 210B moves all the way in the direction of the valve seat 210A. When fluid flow into the reaming tool (41 in FIG. 2) is zero or below a selected threshold rate, a biasing device 210C, which may be a coil spring, urges the valve shuttle 210B away from the valve seat 210A such that flow passages 210G are held open. A fluid inlet 210F to the valve body 210D is hydraulically connected to the passages 210G when the valve shuttle 210B is in the position shown in FIG. 2B, i.e., when there is insufficient fluid flow to overcome the force of the spring 210C.

In the present example embodiment, the duck valve (duckbill valve) 218 may be urged to close passage to the annular space 212, such that when fluid is moved through the interior passage, back flow through the annular space is substantially prevented. As explained previously, when LCM is added to the pumped fluid, the fluid flow rate is often lower than the flow rate used during operation of the motor.

FIG. 2C shows an oblique cut away view of the diverter/dump valve 210 to more clearly illustrate some of the internal flow passages.

In FIG. 2D, when the reaming tool (200 in FIG. 2) is operated at higher fluid flow rates, the increased flow overcomes the force of the spring 210C, such that the valve shuttle 210B moves toward and engages the valve seat 210A. In this way, fluid flow to the interior passage 211 is closed, and is also diverted to the upper end of the annular space 212, thereby providing fluid flow to operate the motor. The duck valve 216 may be deflected by the fluid flow and thus open the annular space 212 to entry of fluid from the interior of the housing. As explained previously, higher flow may be associated with operations not requiring the use of LCM, thus avoiding plugging the power section of the motor.

Figure 3:
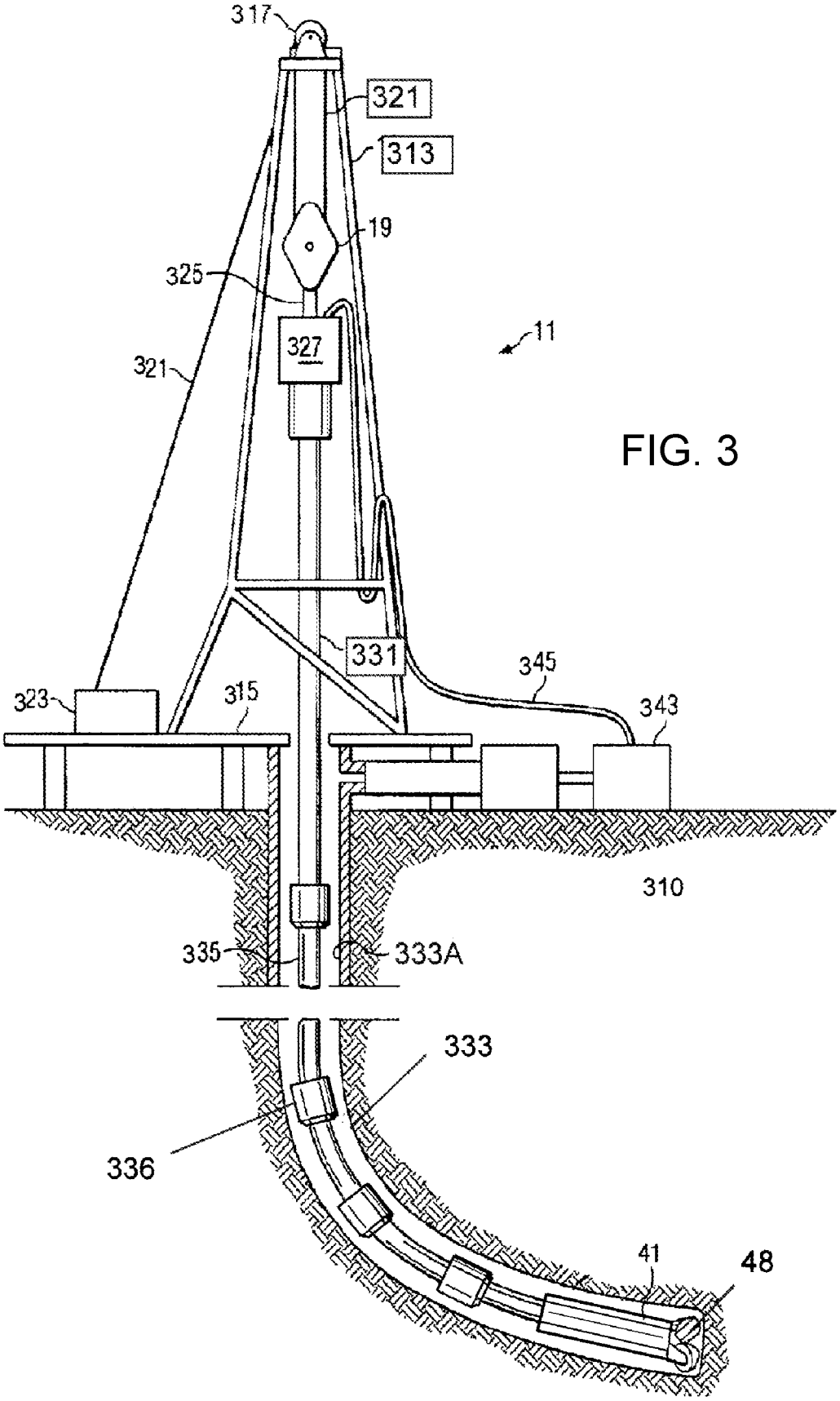
FIG. 3 shows running a well lining tubular, e.g., casing, using a mud motor as in FIG. 2 having a reaming shoe on the output end of the motor.

FIG. 3 shows a drilling rig designated generally by numeral 311. The drilling rig 311 in FIG. 3 is depicted as a land rig. However, as will be apparent to those skilled in the art, the method and apparatus of the present disclosure will find equal application to marine rigs, such as jack-up rigs, semisubmersibles, drill ships, and the like.

The drilling rig 311 includes a derrick 313 that is supported on the ground above a rig floor 315. The drilling rig 311 includes a hoisting system or lifting gear, which includes a crown block 317 mounted near the top of the derrick 313 and a traveling block 319. The crown block 317 and traveling block 319 are interconnected by a line or cable 321 that is driven by a winch (draw works) 323 to control the upward and downward movement of the traveling block 139 in the derrick 313. The traveling block 319 carries a hook 325 from which is suspended a top drive 327. The top drive 327 supports a drill siring or other pipe string, designated generally by the numeral 331, in a well 333. The top drive 327 can be operated to rotate the pipe string 331 in either direction, and by operating the draw works 323, the vertical position of the top drive 327 in the derrick 313 may be changed to move the pipe string 331 along the well 333. An upper part of the well 33 may be protected by a conductor pipe 33A, through which the pipe string 331 passes as the pipe string 331 is moved along the well 333.

The pipe string 331 includes a plurality of interconnected sections of pipe 335, such as drill pipe or other segmented pipe, connected at one end to an assembled length or "string" of well lining tubulars such as casing or liner, shown generally at 336, being inserted into the well 333 during casing or liner running operations.

A reaming tool 41, which may comprise a mud motor, e.g., a mud motor such as explained above with reference to FIGS. 2, 2A, 2B, 2C and 2D is connected to the bottom of the string of casing or liner 36. Drilling or other well intervention fluid is delivered to the pipe string 331 and then to the casing or liner 336 by mud pumps 343 through a mud hose 345. During insertion of the casing or liner 336, the pipe string 331 may be rotated back and forth and/or axially reciprocated to facilitate movement along the well 333. The rig operator (driller) can operate the top drive 327 and the draw works 323 to effect such movement of the pipe string 331. The mud motor 41 may be an annular motor having an internal flow diverter and various valves arranged to operate in a manner as explained with reference to FIGS. 2B, 2C and 2D and as further below. Operating the mud pumps 343 to move drilling mud (or other suitable fluid) through the pipe string 331, casing or liner 336 and the reaming tool 41 causes the mud motor (200 in FIG. 2) of the reaming tool 41 to rotate. Such rotation rotates a reaming shoe 48 coupled to an end of the reaming tool 41, thereby facilitating moving the casing or liner 336 to the bottom of the well 333.

During such operations, if it proves necessary to add LCM to the drilling mud or other fluid to reduce fluid losses into certain formations 310 penetrated by the well 333, then the rig operator may reduce the operating rate of the mud pumps 343 so that the dump valve (214 in FIG. 2A) closes flow to the motor annulus (212 in FIG. 2A), and opens flow to the motor interior passage (211 in FIG. 2A) to reduce the possibility of clogging the turbine elements of the reaming tool 41. Once casing running and contemporaneous reaming is to be resumed, the rig operator may increase the operating rate of the mud pumps 343 so that the dump valve (214 in FIG. 2A) closes flow to the motor interior passage (211 in FIG. 2A) and opens flow to the motor annulus (212 in FIG. 2A) such that the flowing fluid resumes rotation of the turbine, and consequently the reaming shoe 48.

A reaming tool used in connection with insertion of protective pipe such as casing or liner into a well may have less susceptibility to clogging in the event it is necessary for the well operator to use lost circulation material (LCM) during pipe running operations.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A reaming tool for use in reaming a well, the reaming tool comprising:

a housing (200) having a connection (202) at one end for coupling to a pipe string, the housing defining at least one of a rotor and a stator of a turbine;

a rotor shaft (208) rotatably supported on the housing (200), the rotor shaft defining the other of a stator and a rotor of the turbine, the rotor shaft defining an interior passage (211), the rotor shaft having a coupling at one end to attach a well intervention tool (48); and a flow diverter (210) disposed within the housing (200), the flow diverter comprising ports to selectively change flow of fluid from an interior of the housing to either of (i) an annular space (212) between the housing (200) and the rotor shaft (208), and (ii) the interior passage (211) of the rotor shaft;

wherein the flow diverter (210) is operable to change the flow of fluid by changing a flow rate of the flow of fluid and wherein the flow diverter comprises a valve disposed in a valve body sealingly engaged with an interior of the housing, the valve body comprising a valve seat, the valve comprising a valve shuttle movably disposed within the valve body, the valve comprising a biasing device to urge the valve shuttle away from the valve seat to open the valve to flow to the interior passage against the flow of fluid, wherein fluid flow about a selected threshold moves the valve shuttle into contact with the valve seat to close fluid flow to the interior passage and open flow to the annular space.

2. The reaming tool of claim 1 wherein the biasing device comprises a coil spring.

3. The reaming device of claim 1, further comprising a duck valve disposed in an hydraulic passage defined by the annular space, the duck valve arranged to block flow from the annular space to the interior of the housing, the duck valve arranged to open flow from the interior of the housing into the annular space.

4. A method for moving a tubular string along a well, comprising:

pumping fluid through a pipe string having a reaming tool attached to one end of the pipe string, the reaming tool comprising a housing having a connection at one end for coupling to a pipe string, the housing defining at least one of a rotor and a stator of a turbine, a rotor shaft rotatably supported on the housing, the rotor shaft defining the other of a stator and a rotor of the turbine, the rotor shaft defining an interior passage, the rotor shaft having a coupling at one end to attach a well intervention tool, a flow diverter disposed within the housing, the flow diverter comprising ports to selectively direct flow of fluid from an interior of the housing to either (i) an annular space between the housing and the rotor shaft, and (ii) the interior passage of the rotor shaft, wherein the flow diverter is operable to change direction of the flow of fluid by changing a flow rate of the flow of fluid;

wherein the pumping fluid is performed at a first rate to cause the fluid flow to be directed to the annular space such that the rotor shaft turns, and a reaming shoe attached to the coupling rotates;

moving the pipe string along the well while the pumping is performed at the first rate;

changing the rate of pumping fluid to a second rate so that the flow is directed to the interior passage of the rotor shaft;

adding lost circulation material to the fluid while pumping at the second rate, wherein the second rate is lower than the first rate.

5. The method claim 4 wherein the flow being directed to the interior passage of the rotor shaft comprises urging a valve shuttle in a valve body away from a valve seat in the valve body, the urging performed by a biasing device arranged to opposed force on the valve shuttle effected by the flow of fluid.

6. The method of claim 4, further comprising causing the flow directed to the annular space to urge a duck valve to open flow in the annular space, the duck valve arranged to close flow from the annular space into the housing.

7. A reaming tool for use in reaming a well, the reaming tool comprising:

a housing (200) having a connection (202) at one end for coupling to a pipe string, the housing defining at least one of a rotor and a stator of a turbine;

a rotor shaft (208) rotatably supported on the housing (200), the rotor shaft defining the other of a stator and a rotor of the turbine, the rotor shaft defining an interior passage (211), the rotor shaft having a coupling at one end to attach a well intervention tool (48);

a flow diverter (210) disposed within the housing (200), the flow diverter comprising ports to selectively change flow of fluid from an interior of the housing to either of (i) an annular space (212) between the housing (200) and the rotor shaft (208), and (ii) the interior passage (211) of the rotor shaft;

wherein the flow diverter (210) is operable to change the flow of fluid by changing a flow rate of the flow of fluid; and a duck valve disposed in an hydraulic passage defined by the annular space, the duck valve arranged to block flow from the annular space to the interior of the housing, the duck valve arranged to open flow from the interior of the housing into the annular space.

8. The reaming tool of claim 7 wherein the flow diverter comprises a valve disposed in a valve body sealingly engaged with an interior of the housing, the valve body comprising a valve seat, the valve comprising a valve shuttle movably disposed within the valve body, the valve comprising a biasing device to urge the valve shuttle away from the valve seat to open the valve to flow to the interior passage against the flow of fluid, wherein fluid flow about a selected threshold moves the valve shuttle into contact with the valve seat to close fluid flow to the interior passage and open flow to the annular space.

9. The reaming tool of claim 8 wherein the biasing device comprises a coil spring.

10. A method for moving a tubular string along a well, comprising:

pumping fluid through a pipe string having a reaming tool attached to one end of the pipe string, the reaming tool comprising a housing having a connection at one end for coupling to a pipe string, the housing defining at least one of a rotor and a stator of a turbine, a rotor shaft rotatably supported on the housing, the rotor shaft defining the other of a stator and a rotor of the turbine, the rotor shaft defining an interior passage, the rotor shaft having a coupling at one end to attach a well intervention tool, a flow diverter disposed within the housing, the flow diverter comprising ports to selectively direct flow of fluid from an interior of the housing to either (i) an annular space between the housing and the rotor shaft, and (ii) the interior passage of the rotor shaft, wherein the flow diverter is operable to change direction of the flow of fluid by changing a flow rate of the flow of fluid;

wherein the pumping fluid is performed at a first rate to cause the fluid flow to be directed to the annular space such that the rotor shaft turns, and a reaming shoe attached to the coupling rotates;

moving the pipe string along the well while the pumping is performed at the first rate;

changing the rate of pumping fluid to a second rate so that the flow is directed to the interior passage of the rotor shaft;

adding lost circulation material to the fluid while performing the pumping at the second rate; and wherein the flow being directed to the interior passage of the rotor shaft comprises urging a valve shuttle in a valve body away from a valve seat in the valve body, the urging performed by a biasing device arranged to opposed force on the valve shuttle effected by the flow of fluid.

11. The method of claim 10 wherein the second rate is lower than the first rate.

12. The method of claim 10, further comprising causing the flow directed to the annular space to urge a duck valve to open flow in the annular space, the duck valve arranged to close flow from the annular space into the housing.

13. A method for moving a tubular string along a well, comprising:

pumping fluid through a pipe string having a reaming tool attached to one end of the pipe string, the reaming tool comprising a housing having a connection at one end for coupling to a pipe string, the housing defining at least one of a rotor and a stator of a turbine, a rotor shaft rotatably supported on the housing, the rotor shaft defining the other of a stator and a rotor of the turbine, the rotor shaft defining an interior passage, the rotor shaft having a coupling at one end to attach a well intervention tool, a flow diverter disposed within the housing, the flow diverter comprising ports to selectively direct flow of fluid from an interior of the housing to either (i) an annular space between the housing and the rotor shaft, and (ii) the interior passage of the rotor shaft, wherein the flow diverter is operable to change direction of the flow of fluid by changing a flow rate of the flow of fluid;

wherein the pumping fluid is performed at a first rate to cause the fluid flow to be directed to the annular space such that the rotor shaft turns, and a reaming shoe attached to the coupling rotates;

moving the pipe string along the well while the pumping is performed at the first rate;

changing the rate of pumping fluid to a second rate so that the flow is directed to the interior passage of the rotor shaft; and causing the flow directed to the annular space to urge a duck valve to open flow in the annular space, the duck valve arranged to close flow from the annular space into the housing.

14. The method of claim 13 further comprising adding lost circulation material to the fluid while performing the pumping at the second rate.

15. The method of claim 14 wherein the second rate is lower than the first rate.

16. The method claim 14 wherein the flow being directed to the interior passage of the rotor shaft comprises urging a valve shuttle in a valve body away from a valve seat in the valve body, the urging performed by a biasing device arranged to opposed force on the valve shuttle effected by the flow of fluid.

* * * * *